US007448165B2

(12) United States Patent
Woods et al.

(10) Patent No.: US 7,448,165 B2
(45) Date of Patent: Nov. 11, 2008

(54) METHOD OF CLOSING A RADIO FREQUENCY DOOR

(75) Inventors: Elmer B. Woods, West Bend, WI (US); Bruce A. Bliefnick, Fond du Lac, WI (US); Matthew Boesel, Muskego, WI (US)

(73) Assignee: PDC Facilities, Inc., Hartland, WI (US)

( * ) Notice: Subject to any disclaimer, the term of this patent is extended or adjusted under 35 U.S.C. 154(b) by 552 days.

(21) Appl. No.: 10/974,524

(22) Filed: Oct. 27, 2004

(65) Prior Publication Data

US 2006/0086051 A1 Apr. 27, 2006

(51) Int. Cl.
*E05F 11/54* (2006.01)

(52) U.S. Cl. ..... 49/324; 292/341.15; 292/341.16

(58) Field of Classification Search ..... 49/379, 49/324, 394; 292/341.16, 341.13, 341.15, 292/341.19

See application file for complete search history.

(56) References Cited

U.S. PATENT DOCUMENTS

| | | | | | |
|---|---|---|---|---|---|
| 2,981,561 | A | | 4/1961 | Leslie | |
| 3,572,065 | A | | 3/1971 | Peters | |
| 3,572,066 | A | | 3/1971 | Peters | |
| 4,707,007 | A | | 11/1987 | Inoh | |
| 4,775,178 | A | * | 10/1988 | Boyko | 292/341.16 |
| 4,786,758 | A | * | 11/1988 | Zielinski | 174/369 |
| 4,815,773 | A | | 3/1989 | Merrel | |
| 4,867,496 | A | * | 9/1989 | Thomas | 292/341.16 |
| 5,039,826 | A | * | 8/1991 | Newland | 174/374 |
| 5,100,186 | A | | 3/1992 | Nordvall | |
| 5,746,459 | A | | 5/1998 | Girous, Jr. et al. | |
| 6,005,306 | A | | 12/1999 | Pickard | |
| 6,022,056 | A | * | 2/2000 | Cope et al. | 292/144 |
| 6,966,585 | B2 | * | 11/2005 | Egi et al. | 292/341 |
| 2003/0011200 | A1 | | 1/2003 | Oxley et al. | |
| 2003/0075934 | A1 | * | 4/2003 | Oxley et al. | 292/341.16 |
| 2006/0049648 | A1 | * | 3/2006 | Stein | 292/341.16 |

* cited by examiner

*Primary Examiner*—Gregory J. Strimbu
(74) *Attorney, Agent, or Firm*—Michael Best & Friedrich LLP

(57) ABSTRACT

A door and door frame assembly having a door closing mechanism adapted to provide sufficient closing force to the door so that the door engages and sufficiently compresses a gasket between the door and the door frame to prevent electromagnetic interference, such as environmental radio frequencies, from passing between the door and door frame. The door closing mechanism moves a strike plate relative to the door frame to close the door once it is latched to the strike plate. The strike plate is moveable between an extended position and a retracted position relative to the door frame. In the extended position, the gasket is not sufficiently compressed between the door and door frame even though the door is latched. In the retracted position, the gasket is sufficiently compressed between the door and the door frame to attenuate the passage of electromagnetic interference between the door and door frame.

10 Claims, 7 Drawing Sheets

METHOD OF CLOSING A RADIO FREQUENCY DOOR

BACKGROUND

Medical facilities, laboratories, and other facilities can have specially constructed rooms that are used for conducting procedures or operating equipment that is sensitive to environmental radio frequency interference or subject to TEMPEST requirements. These rooms can be used for magnetic resonance imaging or other applications where environmental radio frequencies could impede performance of the equipment. In some situations, such rooms can also protect against evesdropping. Generally, these specially constructed rooms are designed to prevent or attenuate environmental radio frequency interference from entering or leaving the room. Environmental radio frequency interference can come from any number of sources, such as television and radio signals, power equipment, motors, fluorescent lights, computers, other medical equipment, and the like.

Part of the specialized construction for these rooms includes special doors and door frames that are designed to prevent or attenuate environmental radio frequencies from entering these rooms. These types of doors generally have a gasket positioned between the door and the door frame. The gasket is compressed between the door and the door frame to make a seal that prevents or attenuates radio frequency transmission from passing between the door and the door frame. A sufficient seal is generally made when the gasket is compressed by about 30 percent to about 50 percent between the door and the door frame. The force necessary to close the door and properly compress the gasket is dependent upon the thickness of the gasket installed. Consequently, larger gaskets generally require more force to compress. Depending upon the size of the gasket installed, radio frequency doors generally require between about 150 and about 450 pounds of force to move the door closed against the door frame to create a radio frequency seal. Accordingly, some conventional doors require slamming the door shut to produce the necessary closing force to latch the door and sufficiently compress the gasket.

SUMMARY OF THE INVENTION

The present invention is directed toward a door closing mechanism adapted to provide sufficient closing force to a door so that the door engages and sufficiently compresses a gasket against the door frame to prevent electromagnetic interference, such as environmental radio frequencies and other signals, from passing between the door and door frame. The door closing mechanism moves a strike plate relative to the door frame to close the door once it is latched to the strike plate.

For example, one embodiment is directed toward a door and door frame combination for attenuating the passage of radio frequencies and other signals between the door and door frame. The combination includes a door frame and a door pivotally coupled to the door frame for movement between at least three positions including an unlatched open position, a latched open position, and latched closed position. The unlatched open position allows radio frequencies to freely pass between the door and door frame. The latched closed position substantially attenuates the passage of radio frequencies between the door and door frame. Finally, the latched open position is between the open and latched close positions.

A gasket is positioned between the door and door frame. The gasket is made from a material adapted to attenuate radio frequency when compressed between the door and the door frame. The gasket is compressed between the door and door frame when the door is in the latched closed position. A retractable latch is coupled to the door and a strike plate is coupled to the door frame. The strike plate is adapted to receive the retractable latch and is moveable in a first direction relative to the door frame between an extended position and a retracted position to move the door from the latched open position in which the retractable latch is received within the strike plate to the latched closed position in which the gasket is compressed between the door and the door frame. The strike plate applies a force against the retractable latch in the first direction to move the door between the latched open position and the latched closed position.

Some embodiments also include a latch release mechanism coupled to the door frame and positioned to unlatch the door by selectively engaging the retractable latch to remove the latch from strike plate. The latch release mechanism includes an actuator coupled to a rod that is moveable between an extended position and a retracted position. Actuation of the rod to the extended position causes the retractable latch to be removed from the strike plate.

Another embodiment is directed toward a door latch mechanism for manipulating the position of a door relative to a door frame to control the passage of electromagnetic and other signals between the door frame and the door, where the door has a retractable latch selectively received within a strike plate of the door frame to latch the door. The door latch mechanism is adapted to move the door relative to the door frame between at least two positions including a latched open position and latched closed position. The latched open position allows electromagnetic signals to pass between the door and door frame, and the latched closed position substantially attenuates the passage of electromagnetic signals between the door and door frame relative to the latched open position.

The door latching mechanism includes a cam coupled to the door frame and positioned within a cavity at least partially defined by the door frame. The cam is adapted to translate in a first direction. A follower is positioned at least partially within an elongated aperture of the cam. Also, a guide block is coupled to the strike plate and slidably received within a recess of the door frame. The guide block is coupled to the follower to move the strike plate in a second direction substantially normal to the first direction. The guide block has an aperture for receiving the retractable latch. An actuator is coupled to the cam to move the cam relative to the follower. Actuation of the actuator causes the cam to translate in the first direction, which also causes the follower, guide block, and strike plate to translate in the second direction. This moves the door from the latched open position to the latched closed position. Some embodiments of the door latch mechanism also include a latch release mechanism coupled to the door frame and positioned to unlatch the door by selectively engaging the retractable latch to cause the latch to retract from strike plate.

Another embodiment is directed to a method of latching a door to a door frame. The method includes partially closing the door and engaging a retractable latch of the door with a strike plate. The strike plate moves relative to the door frame to translate from an extended position to a retracted position. The door moves further towards the door frame by moving the strike plate to the retracted position and compresses a gasket between the door and door frame. Accordingly, the passage of electromagnetic interference between the door and door frame is attenuated by compressing the gasket.

These and other aspects of the present invention, together with the organization and operation thereof, will become apparent from the following detailed description of the invention when taken in conjunction with the accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect.

DESCRIPTION OF THE ILLUSTRATED EMBODIMENTS

Figure 1:
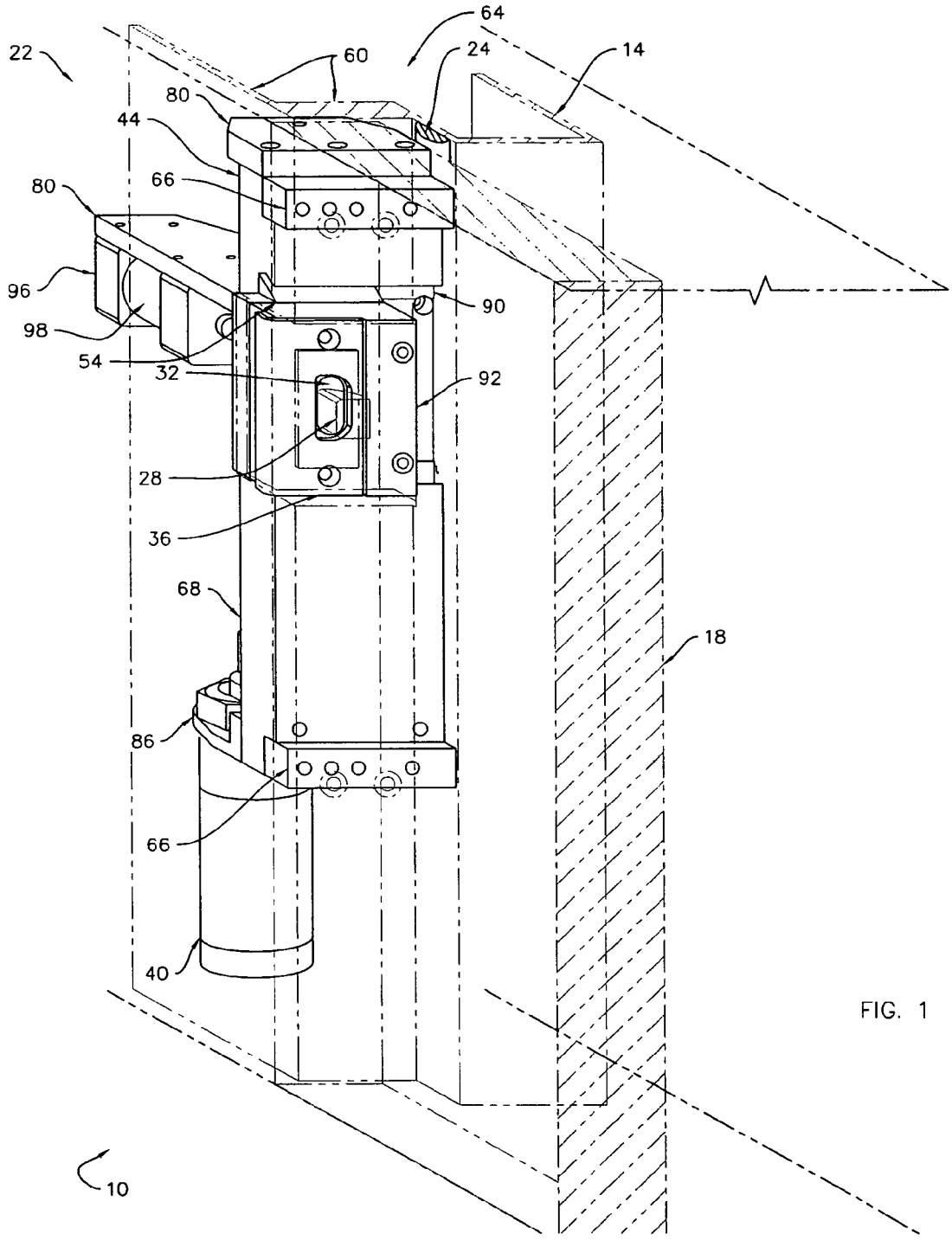
FIG. 1 is a front perspective view of a door closing mechanism coupled to a door frame, where the door is engaged with the strike plate in a latched open position.
Figure 2:
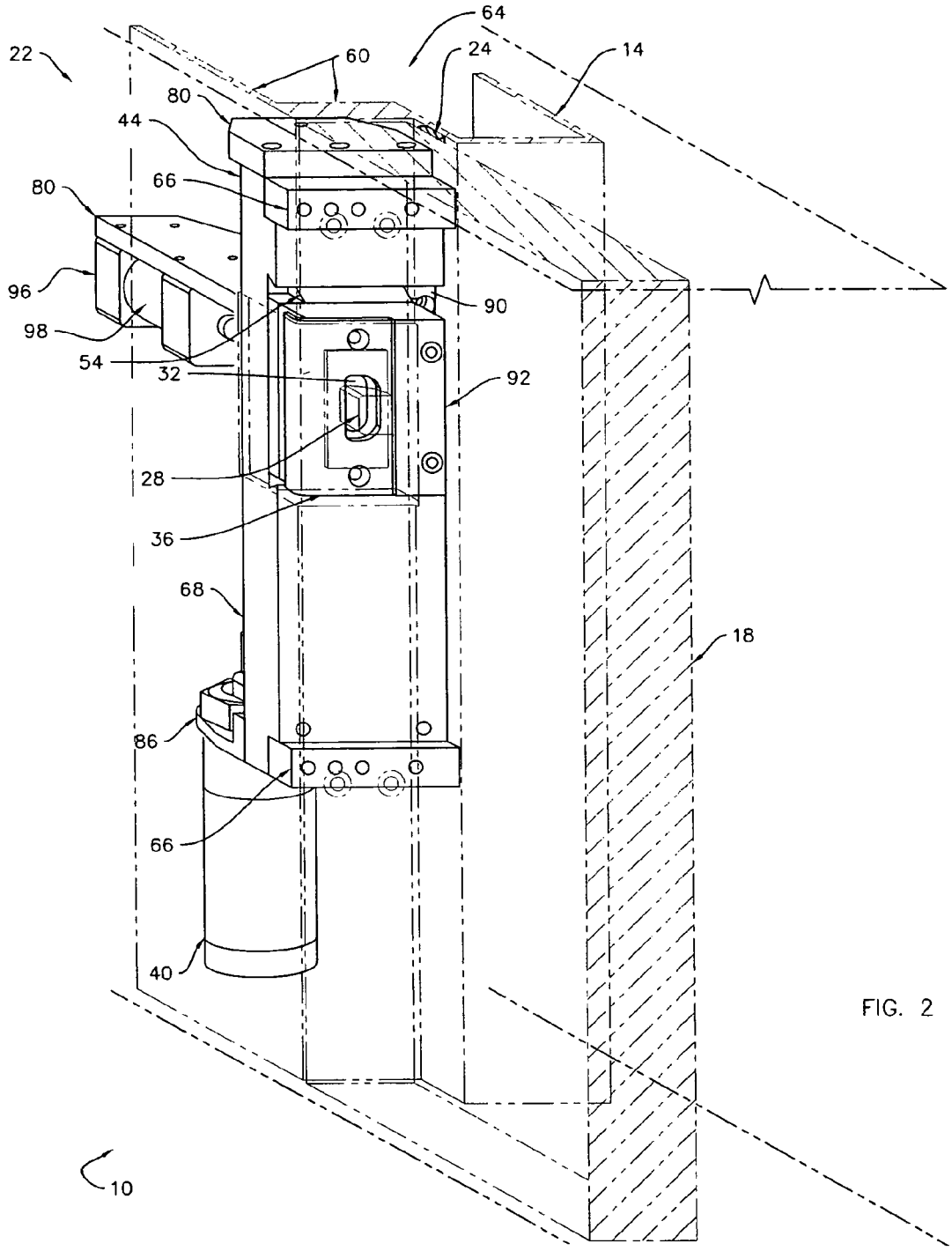
FIG. 2 is a front perspective view of the door closing mechanism of FIG. 1, where the door closing mechanism has been actuated to move the door to a latched closed position.

FIGS. 1 and 2 illustrate a portion of a door assembly 10 adapted to prevent environmental radio frequencies or other electromagnetic radiation from passing through the door assembly 10. The door assembly 10 includes a door frame 14, a door 18 coupled to the door frame 14, and door closing mechanism 22 coupled to the door frame 14.

The door 18 and door frame 14 are constructed of materials that prevent the passage or transmission of radio waves through the door 18 and door frame 14. For example, the door 18 and door frame 14 can be constructed from aluminum or other non-ferrous materials, steel or other ferrous materials, and the like. The specific application of the door may determine whether ferrous or non-ferrous materials can be used.

The door 18 is connected to the door frame 14 by one or more hinges (not shown). Accordingly, the door 18 can be moved through a variety of positions with respect to the frame 14 to selectively allow passage through the door frame. For example, the door 18 can be positioned in a variety of open positions with respect to the door frame 14, where varying levels of electromagnetic interference can pass between the door 18 and the door frame 14.

The door 18 also has a closed position where the passage of electromagnetic interference between the door 18 and the door frame 14 is prevented or substantially attenuated. In the closed position, the door 18 compresses a gasket 24 against the door frame 14 to form a seal that prevents or minimizes electromagnetic interference from passing between the door 18 and the door frame 14. The gasket 24 is generally compressed between about 30 percent and about 50 percent to form the seal. Depending upon the size, type, and amount of compression of the gasket 24, it can take up to 450 pounds of force to close the door 18 against the gasket 24. These pressures generally render conventional automatic latching systems inoperative.

The gasket 24 can be made from a variety of materials that attenuate the passage of electromagnetic interference between the door 18 and door frame 14, such as many different shielded gasket materials. For example, the gasket 24 can include a beryllium copper gasket, a tin coated copper gasket, a fabric covered foam gasket, and the like. The fabric covered foam gasket is a foam gasket that is covered with a conductive fabric. The conductive fabric helps to form an electrically conductive seal and also helps to attenuate sound transmission.

A retractable latch 28 on the door 18 engages an aperture 32 in a strike plate 36 to hold the door 18 in the closed position against the gasket 24. The retractable latch 28 is movable between at least two positions. In an extended position, the retractable latch 28 can engage the aperture 32 of the strike plate 36. In a retracted position, the retractable latch 28 is moved at least partially within the door 18 to unlatch the door 18 from the strike plate 36. The retractable latch 28 can be moved manually with a handle or door knob. In some embodiments, the retractable latch 28 can also be moved with an automatic system.

The door closing mechanism 22 of the door assembly 10 assists with closing the door 18 by providing a closing force to the door 18 to overcome the up to 450 pounds of closing force needed to compress the gasket 24. The door closing mechanism 22 moves the strike plate 36 relative to the door frame 14 to provide the closing force. For example, as shown in FIG. 1, the retractable latch 28 engages the strike plate 36 in an extended position of the strike plate 36. In this position, the door 18 is in a latched open position, such that the gasket 24 is not sufficiently compressed to form a seal against the passage of electromagnetic interference. As shown in FIG. 2, the strike plate 36 can be moved relative to the door frame by an actuator 40. As the actuator 40 causes the strike plate 36 to retract, the door 18 also moves to a latched closed position due to forces applied to the retractable latch 28 via the strike plate 36. In the latched closed position, the door 18 sufficiently compresses the gasket 24 to prevent electromagnetic interference from passing between the door 18 and door frame 14.

Figure 3:
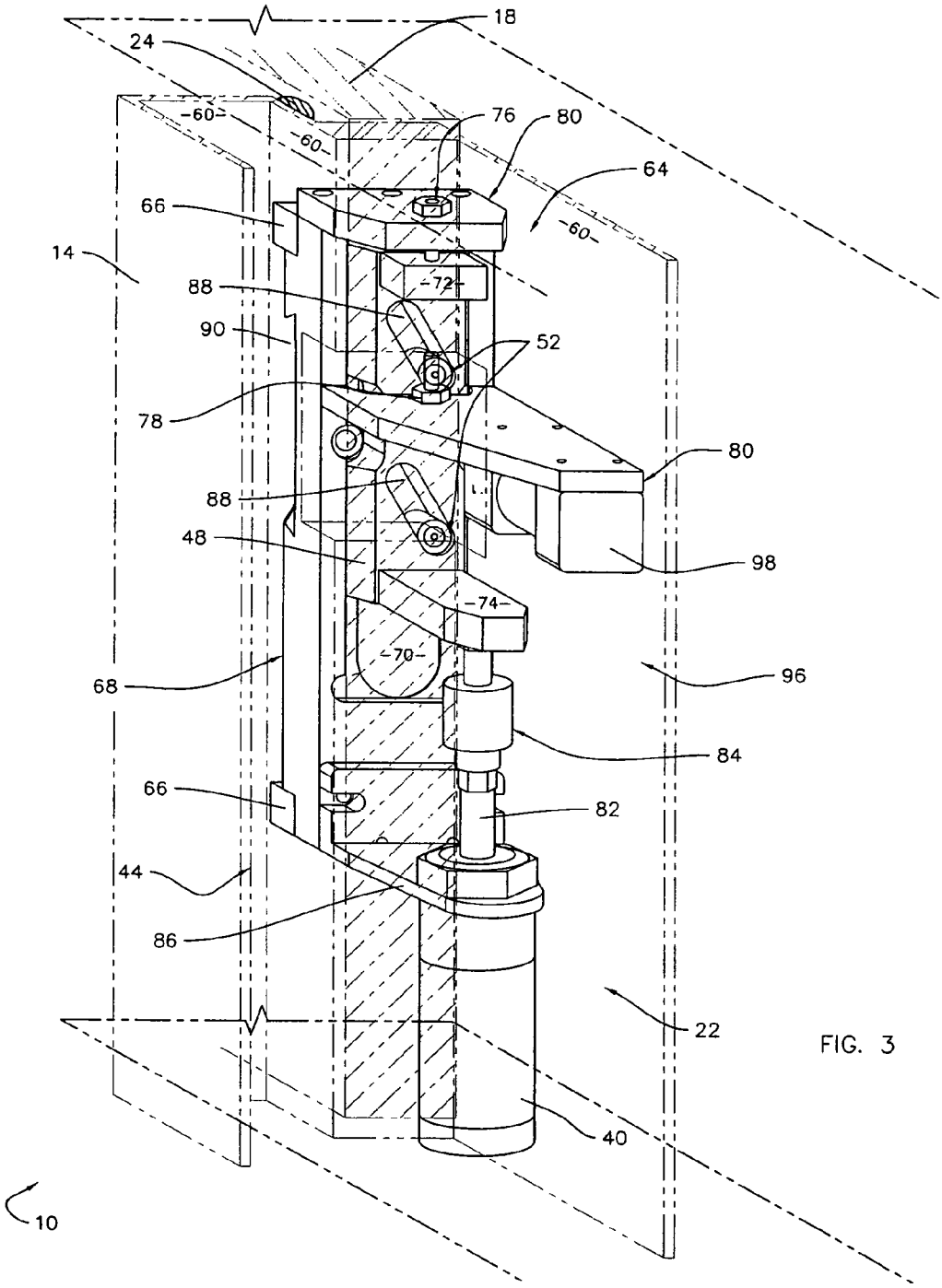
FIG. 3 is a rear perspective view of the door closing mechanism in the position illustrated in FIG. 1.
Figure 4:
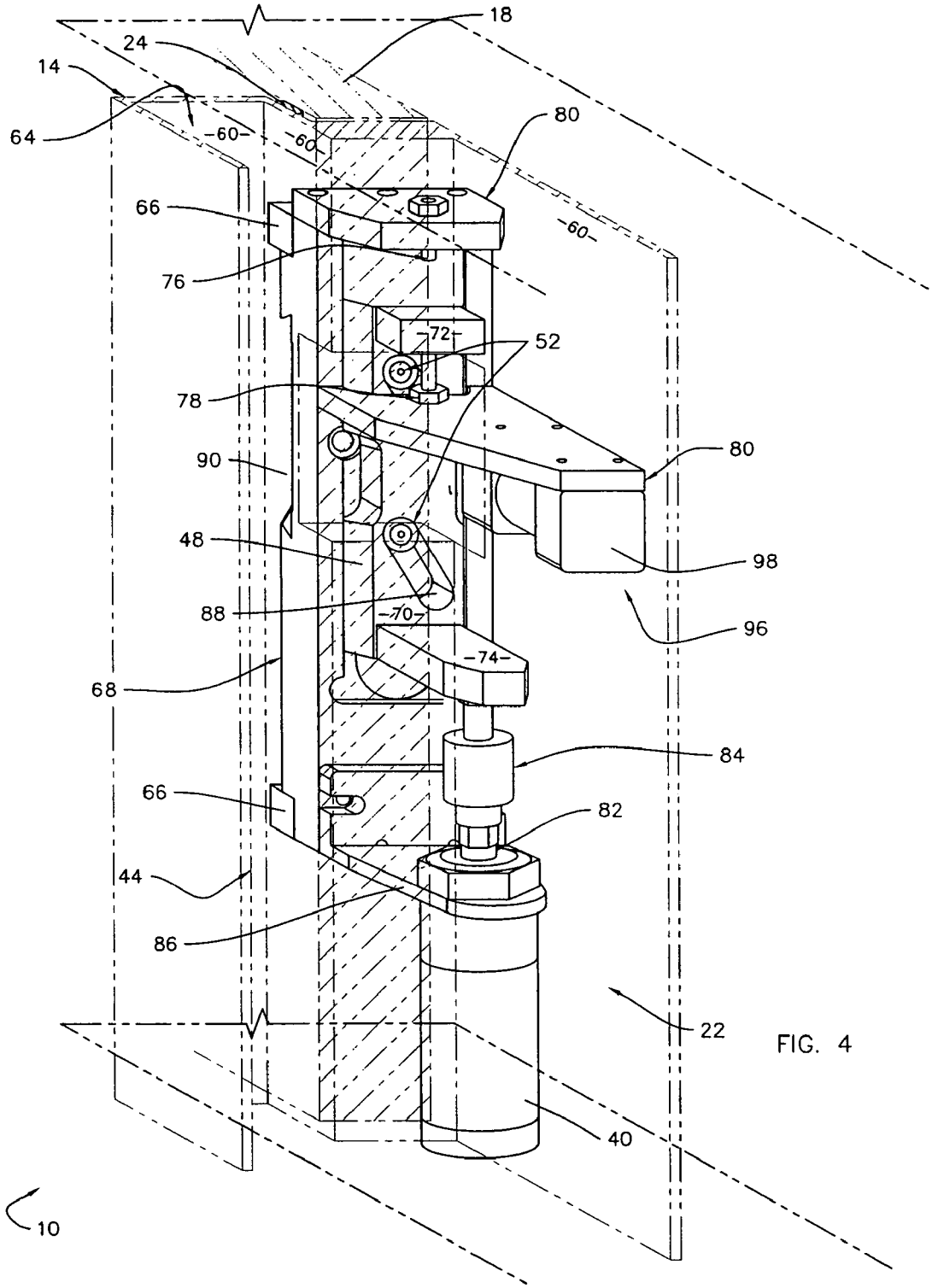
FIG. 4 is a rear perspective view of the door closing mechanism in the position illustrated in FIG. 2.

As best shown in FIGS. 3 and 4, the door closing mechanism 22 comprises a frame 44, a cam 48 coupled to the frame 44, the actuator 40, followers 52 coupled to the cam 48, and a guide block 54 (FIG. 5) coupled to the follower 52. The frame 44 is coupled to an inner surface 60 of the door frame 14 and positioned within a cavity 64 at least partially defined by the door frame 14. The frame 44 includes two frame mounts 66 that are coupled to the inner surface 60 of the door frame 14 and a base plate 68 coupled to the frame mounts 66. The frame mounts 66 position the base plate 68 a desired distance from the inner surface 60 of the door frame 14. Although the frame mounts 66 and the base plate 68 are described and illustrated as being separate components, in some embodiments, these components can be integrally formed. The base plate 68 supports several components of the door closing mechanism 22. For example, the cam 48, the cam followers 52, and the cam actuator 40 are supported on the base plate 68. Although a variety of different types of cams can be used, the illustrated cam 48 is coupled to the base plate 68 for sliding movement along the base plate 68. A portion of the cam 48 rests within an elongated aperture 70 of the base plate 68 to allow translation of the cam 48 along the base plate 68.

As illustrated, the cam 48 has projections 72, 74 positioned at both ends of the cam 48. The first projection 72 is positioned at the top of the cam and serves as a mechanical stop to prevent the cam 48 from moving too far along the base plate 68. With reference to FIGS. 3 and 4, the first projection 72 engages a first stroke adjusting member 76 along the vertical, upward stoke of the cam 48 to stop the cam 48. The first projection 72 also engages a second stroke adjusting member 78 along the downward stroke of the cam 48 to stop the cam 48. The first and second stroke adjusting members 76, 78 extend from separate supports 80 that are coupled to and extend from the base plate 68. Each of the supports 80 are positioned near the end of the cam 48 stroke. The stroke adjusting members 76, 78 extend from the supports 80 to define the stop positions of the cam 48 stroke. The stroke adjusting members 76, 78 can be threaded to the supports 80 to allow for easy adjustment of the stop position.

The second projection 74 extends from the bottom of the cam 48 and provides an area for the actuator 40 to act against. The actuator 40 can be coupled to the second projection 74 as shown in FIGS. 3 and 4. Although a variety of actuators can be utilized with the present invention, the figures illustrate an air cylinder as the actuator 40. Accordingly, the rod 82 of the air cylinder actuator 40 is coupled to the second projection 74 of the cam 48. The rod 82 is coupled to the second projection 74 via a coupling 84 to allow the actuator 40 to provide both pulling and pushing forces to the cam 48. However, in other embodiments, the rod 82 can merely abut the cam 48 to apply force in only one direction of the stroke.

A portion of the actuator 40 is coupled to the base plate 68 of the door closing mechanism 22. Specifically, the cylinder of the air cylinder actuator 40 is coupled to an additional support 86 extending from the base plate 68. The additional support 86 holds the cylinder stationary while the rod 82 is actuated to cause the cam 48 to translate along the base plate 68 in a generally vertical direction.

The followers 52 are positioned to contact the cam 48 so that actuation of the cam 48 moves the followers 52. The followers 52 are positioned within apertures 88 extending along portions of the cam 48. Each aperture 88 extends at an angle with respect to the direction of travel of the cam 48 so that movement of the cam 48 in the vertical direction causes the followers 52 to translate in a direction substantially normal to the direction of movement of the cam 48. Although some embodiments can use only one follower 52, the illustrated embodiment utilizes two followers 52 received within two separate apertures 88 of the cam 48. This configuration can prevent torsional movement from being transferred through the followers 52 to the strike plate 36.

Although it is not illustrated, the followers 52 are coupled to the guide block 54 shown in FIGS. 1, 2, and 5-7. As shown best in FIG. 3, the followers 52 rotate about shafts that extend from the guide block 54. As shown in FIGS. 1-4, the guide block 54 is at least partially positioned within a transverse recess 90 of the base plate 68. The upper and lower ends of the guide block 54 and recess 90 have a mating configuration. For example, as illustrated, these surfaces have mating, angled planar surfaces to retain the guide block 54 within the recess 90. Accordingly, as the cam 48 moves, the recess 90 and the followers 52 cause the guide block 54 to move in a direction substantially normal to the direction of movement of the cam 48.

The strike plate 36 is coupled to the guide block 54 via a strike mount 92. The strike mount 92 is coupled to the guide block 54 and it has a recess 94 for receiving the retractable latch 28 of the door 18. Accordingly, the strike plate 36 will move with the guide block 54 to move the door 18 into sealed engagement with the door frame 14 during actuation of the door closing mechanism 22. In some embodiments, the strike mount 92 and guide block 54 can be one unitary structure, rather than two separate structures coupled together.

Figure 5:
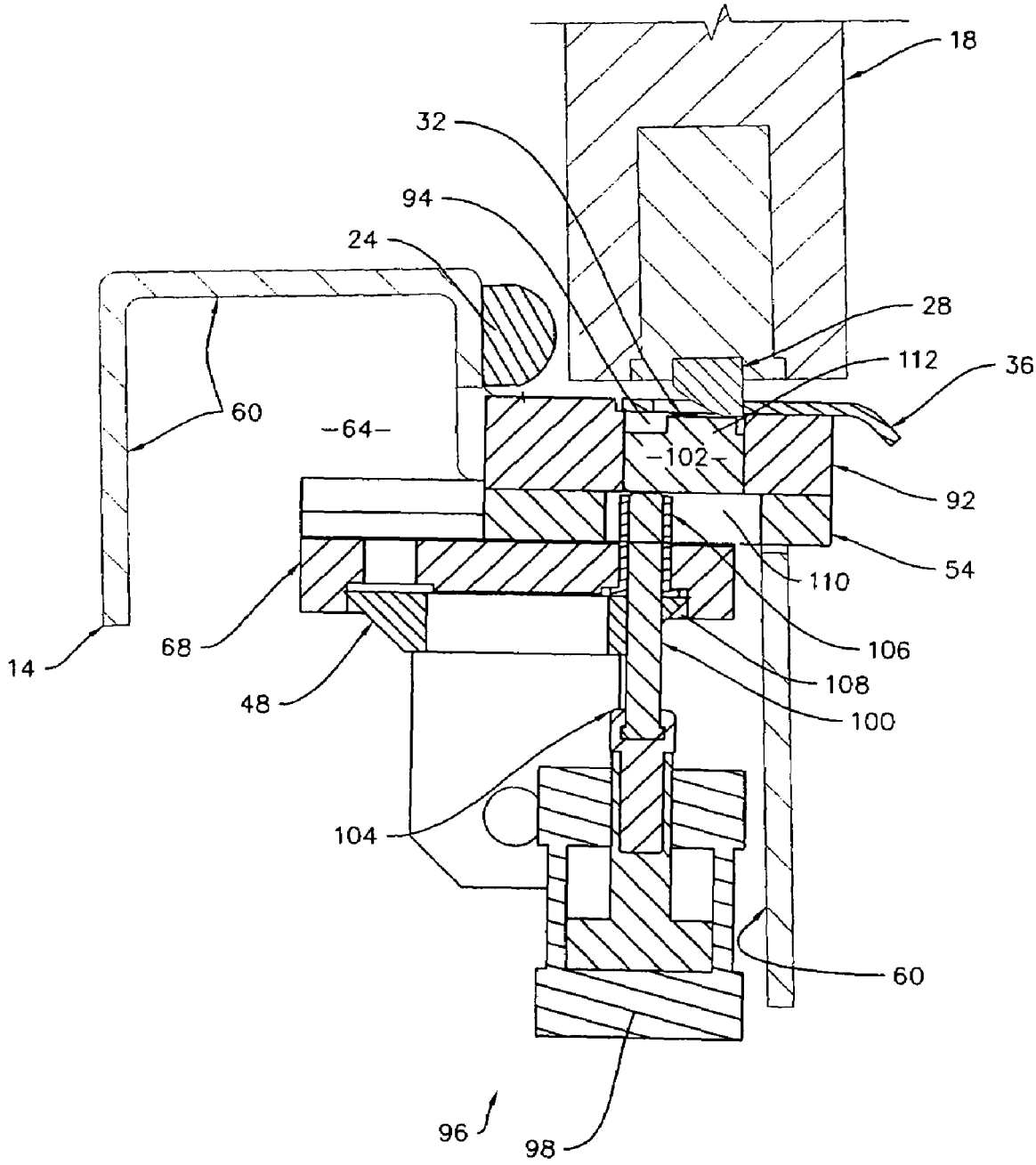
FIG. 5 is a cross-section taken through a latch release mechanism illustrated in FIGS. 1-4, where the door closing mechanism is in the position illustrated in FIG. 1 and the latch release mechanism is in a retracted position.

In operation, the door 18 can be placed into the latched open position as shown in FIGS. 1, 3, and 5. In this position, the retractable latch 28 of the door 18 engages the aperture 32 of the strike plate 36 while the strike plate 36 is in the extended position. With the strike plate 36 in the extended position, the door 18 does not sufficiently engage and/or compress the gasket 24 positioned between the door 18 and the door frame 14 to prevent electromagnetic radiation from passing between the door 18 and the door frame 14.

Figure 6:
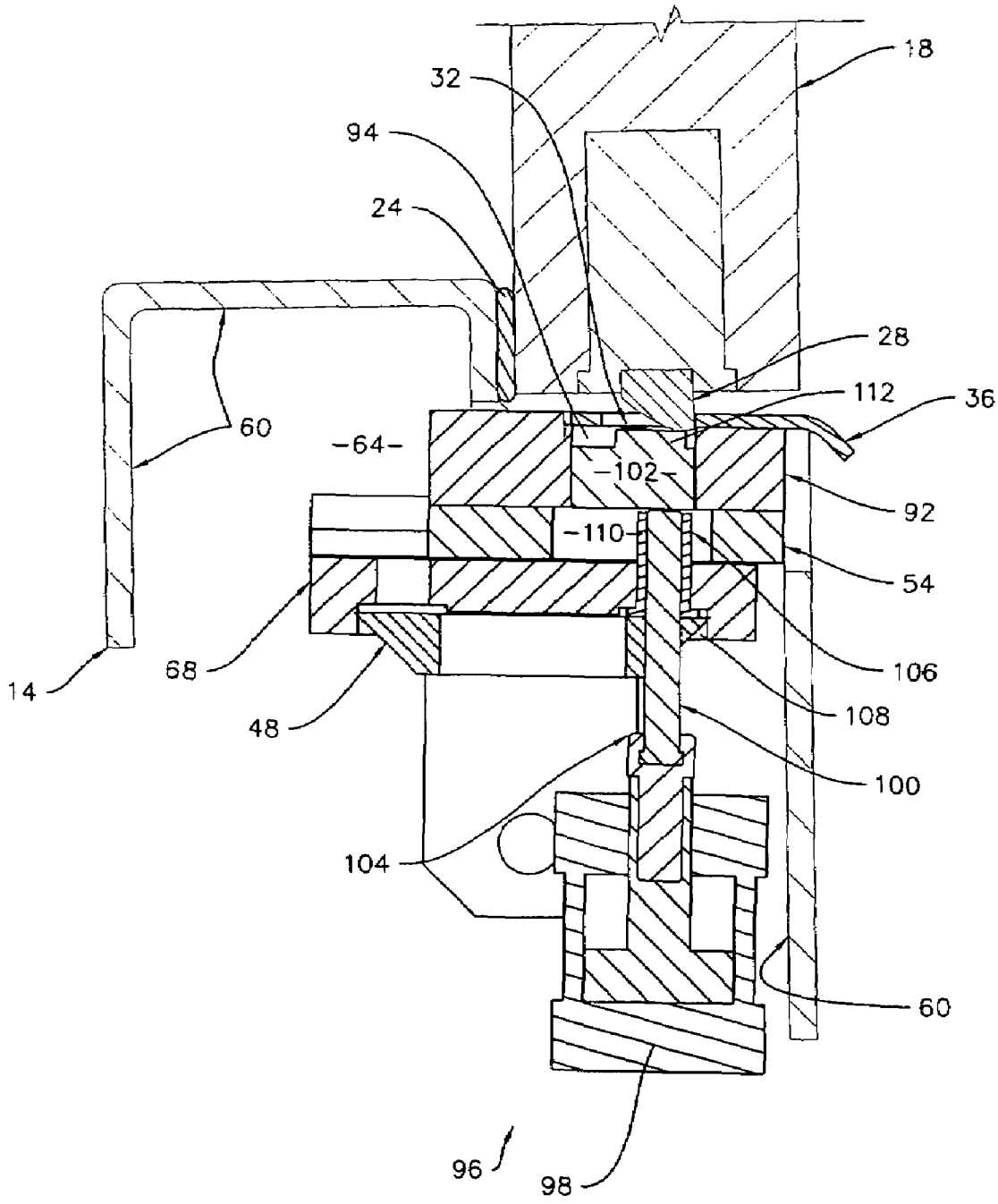
FIG. 6 is a cross-section taken through a latch release mechanism illustrated in FIGS. 1-4, where the door closing mechanism is in the position illustrated in FIG. 2 and the latch release mechanism is in a retracted position.

The actuator 40 is actuated to begin moving the door 18 from the latched open position to the latched closed position shown in FIGS. 2, 4, and 6. As illustrated, the actuator 40 causes the cam 48 to move in a generally vertical downward direction relative to the door frame 14. This causes the followers 52 to move from the forward position shown in FIG. 3 to the rearward position shown in FIG. 4. Movement of the followers 52 also causes the guide block 54 to translate, which moves the strike plate 36 from the extended position shown in FIGS. 1 and 5 to the retracted position shown in FIGS. 2 and 6. In the retracted position, the door 18 sufficiently compresses and engages the gasket 24 to compress the gasket against the door frame 14 to form a seal that prevents electromagnetic interference from passing between the door 18 and door frame 14.

As noted above, conventional systems generally cannot latch the door and develop the pressure needed on the door from the gasket to sufficiently seal the door. Also, conventional systems, once latched and closed, are not operable to unlatch and open because of the forces generated by the compressed gasket. The door closing mechanism 22 of the present invention operates to move the door 18 between the latched open and latched closed positions even under the force required to compress the gasket 24. The force required to compress the gasket 24 is at least 50 pounds in some embodiments, at least 100 pounds in other embodiments, at least 150 pounds in yet other embodiments, and between about 50-450 pounds in some other embodiments.

The door 18 can be moved from the unlatched position to the latched open position several ways. For example, a person can pivot the door 18 about its hinge to move it from an unlatched position to the latched open position. In some embodiments, however, an actuation system can be used to automatically move the door 18 from the unlatched position to the latched open position. Since the door closing mechanism 22 described above is used to overcome the forces of the gasket 24 and compress the gasket 24 between the door 18 and the door frame 14, the actuation system does not have to be very robust. Specifically, the actuation system need only provide minimal forces to the door 18 to pivot it about its hinge.

As shown in the drawings, some embodiments also have a latch release mechanism 96. The latch release mechanism 96 is coupled to the base plate 68 and positioned to selectively engage the retractable latch 28 of the door 18. Upon actuation of the latch release mechanism 96, the retractable latch 28 is driven toward a retracted position to disengage the strike plate 36 and unlatch the door 18.

The latch release mechanism 96 comprises an actuator 98, a release pin 100 coupled to the actuator 98, and a latch release member 102 abutting the release pin 100. The actuator 98 is an air cylinder. However, in other embodiments, other actuators can be used. The air cylinder is coupled to one of the supports 80 extending from the base plate 68. A rod 104 extends from the cylinder and is actuated by the cylinder. The rod 104 is coupled to the release pin 100, which passes through and rests in a bushing 106 in an aperture 108 of the base plate 68. The release pin 100 also extends through an aperture 110 of the guide block 54. The release pin 100 is positioned to extend into the aperture 94 of the strike mount 92 and push the latch release member 102.

Figure 7:
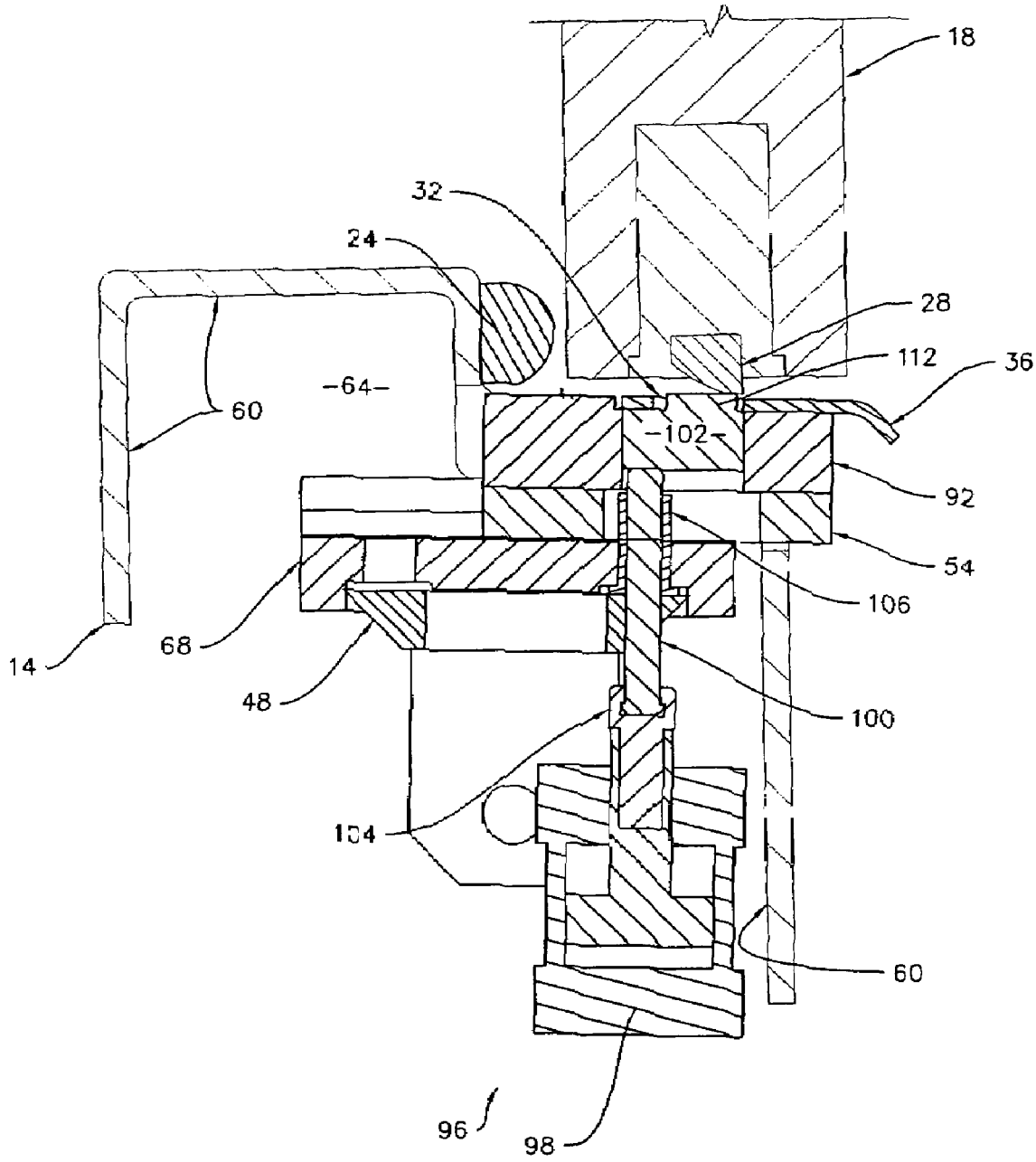
FIG. 7 is a cross-section taken through a latch release mechanism illustrated in FIGS. 1-4, where the door closing mechanism is in the position illustrated in FIG. 1 and the latch release mechanism is in an extended position.

The latch release member 102 rests within the aperture 94 of the strike mount 92 and is positioned to translate between a retracted position shown in FIGS. 5 and 6 and an extended position shown in FIG. 7. The latch release member 102 has a projection 112 that is positioned to extend into the aperture 32 of the strike plate 36 and drive the retractable latch 28 out of the strike plate aperture 32. The latch release member 102 is translated to the extended position upon actuation of the release pin 100. As the release pin 100 extends, it pushes the latch release member 102 and causes it to translate to the extended position. As the release pin 100 is retracted, the latch release member 102 returns to the retracted position due to a bias force exerted on the latch release member 102 from one or more springs. The springs are positioned between the strike plate 36 and the latch release member 102. Upon actuation of the latch release member 102, the springs are compressed against the strike plate 36 by the latch release member 102. This stored potential energy biases the latch release member 102 to the retracted position once the release pin 100 is retracted.

Unlike most conventional automatic latching systems, the latch release mechanism 96 can develop sufficient force to overcome the forces between the retractable latch 28 and the strike plate 36. These forces on the retractable latch 28 are generated by the gasket pushing on the door. In operation, the actuator 98 of the latch release mechanism 96 is actuated to unlatch and open the door 18. Actuation of the actuator 98 drives the release pin 100 toward the door 18. Accordingly, the release pin 100 drives the latch release member 102 toward the door 18, which causes the retractable latch 28 to be driven from the strike plate aperture 32 into an at least partially retracted position within the door 18. Assuming the latch release mechanism 96 is actuated while the door 18 is in the closed latched position, the force of the gasket 24 against the door 18 would drive the door 18 to an open position once the retractable latch 28 is driven from engagement with the strike plate 36. The latch release mechanism 96 can also be actuated while the door 18 is in the open latched position. With the door 18 in this position, the force of the gasket 24 against door 18 may or may not cause the door 18 to move to a further open position. However, the latch release mechanism 96 can remain in the extended position for an extended period of time to prevent the retractable latch 28 from inadvertently engaging the strike plate aperture 32.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments. All of these different combinations constitute various alternative aspects of the present invention.

Various features of the invention are set forth in the following claims.

We claim:

1. A method of latching a door to a door frame, the method comprising:

beginning closure of the door;

engaging a latch of the door with a strike plate of the door frame, wherein said latch is at least partially retractable into the door;

moving the strike plate relative to the door frame to cause the strike plate to translate from an extended position to a retracted position, thereby causing the door to move further toward the door frame;

compressing a gasket between the door and door frame by moving the strike plate to the retracted position; and attenuating the passage of electromagnetic radiation between the door and door frame by compressing the gasket.

2. The method of claim 1, further comprising actuating an actuator to move the strike plate relative to the door frame after engaging the retractable latch with the strike plate.

3. The method of claim 2, further comprising driving a cam with the actuator along a path, movement of the cam causing movement of the strike plate.

4. The method of claim 3, wherein the step of driving the cam with the actuator along the path includes translating the cam in a first direction causing the strike plate to move in a second direction, the first direction being substantially normal to the second direction.

5. The method of claim 3, further comprising driving a follower coupled to the strike plate with the cam, movement of the follower causing movement of the strike plate.

6. The method of claim 5, wherein the step of driving the follower includes driving a guide block that is coupled to the follower and the strike plate.

7. The method of claim 1, further comprising actuating a retractable latch actuator positioned within a cavity at least partially defined by the door frame to move the retractable latch from an extended position to a retracted position to cause the latch to unlatch from the strike plate.

8. The method of claim 7, wherein the step of actuating the retractable latch actuator includes driving a rod coupled to a cylinder with a pressurized source.

9. The method of claim 1, wherein the step of engaging the retractable latch of the door with the strike plate includes moving the door from an unlatched open position to a latched open position.

10. The method of claim 1, wherein the step of moving the strike plate relative to the door frame to cause the strike plate to translate from an extended position to a retracted position includes moving the door from a latched open position to a latched closed position.

* * * * *